US005538460A

United States Patent [19]

Onodera

[11] Patent Number: 5,538,460

[45] Date of Patent: Jul. 23, 1996

[54] APPARATUS FOR GRINDING HARD DISK SUBSTRATES

[75] Inventor: Masami Onodera, Niigata, Japan

[73] Assignee: System Seiko Co., Ltd., Niigata, Japan

[21] Appl. No.: 363,042

[22] Filed: Dec. 23, 1994

Related U.S. Application Data

[63] Continuation of Ser. No. 71,875, Jun. 4, 1993, abandoned, which is a continuation of Ser. No. 821,657, Jan. 16, 1992, abandoned.

[51] Int. Cl.[6] ..... B24B 7/00; B24B 9/00

[52] U.S. Cl. ..... 451/72; 451/56; 125/11.04; 125/11.19

[58] Field of Search ..... 451/21, 56, 72, 451/5, 8, 10, 283, 287, 290, 291, 72, 443, 259; 125/11.04, 11.18, 11.19, 11.20, 11.21

[56] References Cited

U.S. PATENT DOCUMENTS

| | | | |
|---|---|---|---|
| 4,083,350 | 4/1978 | Zogas . | |
| 4,208,842 | 6/1980 | Katzke et al. . | |
| 4,274,388 | 6/1981 | Ivel | 451/56 |
| 4,386,483 | 6/1983 | Schlaefli | 451/72 |
| 4,502,252 | 3/1985 | Iwabuchi . | |
| 4,520,788 | 6/1985 | Melvin . | |
| 4,593,495 | 6/1986 | Kawakami et al. | 451/287 |
| 4,731,954 | 3/1988 | Lillenfein . | |
| 4,897,967 | 2/1990 | Maruyama et al. . | |
| 4,916,868 | 4/1990 | Wittstock . | |
| 4,953,522 | 9/1990 | Vetter . | |
| 4,962,616 | 10/1990 | Wittstock | 451/287 |
| 4,984,390 | 1/1991 | Kobayashi . | |
| 5,025,592 | 6/1991 | Yamamori et al. . | |
| 5,035,087 | 7/1991 | Nishiguchi et al. . | |
| 5,138,799 | 8/1992 | Buckingham et al. | 451/21 |
| 5,224,050 | 6/1993 | Ohta et al. | 451/21 |

FOREIGN PATENT DOCUMENTS

| | | | |
|---|---|---|---|
| 2311632 | 12/1976 | France . | |
| 48708 | 1/1987 | Japan . | |
| 48811 | 11/1988 | Japan . | |
| 0889390 | 12/1981 | U.S.S.R. | 451/72 |

*Primary Examiner*—Bruce M. Kisliuk
*Assistant Examiner*—Derris H. Banks
*Attorney, Agent, or Firm*—Lowe, Price, Leblanc & Becker

[57] ABSTRACT

An apparatus for grinding hard disk substrates includes a dressing unit essentially radially movable across the faces of rotating of grinding wheels for simultaneously dressing one or both of the two confronting surfaces thereof. The apparatus thus constructed is suited to fully automated grinding/dressing operations.

6 Claims, 5 Drawing Sheets

APPARATUS FOR GRINDING HARD DISK SUBSTRATES

This application is a continuation of application Ser. No. 08/071,875 filed Jun. 4, 1993, which is now abandoned and is a continuation of 07/821,657, filed Jan. 16, 1992, now abandoned.

BACKGROUND OF THE INVENTION

1. Field of the Invention

The present invention relates generally to an apparatus for grinding the substrate of a hard disk used in electronic equipment such as computers. More particularly, this invention relates to a substrate grinding apparatus which simplifies high precision dress grinding of grinding wheels used therein. This invention further relates to such a substrate grinding apparatus which is capable of automatically measuring the thickness of a substrate after a grinding operation is completed and automatically operating the dressing means according to the results of measurement of the substrate thickness.

2. Description of the Prior Art

In recent years, the electronic equipment such as computers have exhibited an increasing tendency to use a hard disk drive as an auxiliary storage. This tendency has created a strong demand for production of the hard disk drives in a short period of time and at a low cost. As is well known, the substrate of a hard disk (hereinafter occasionally referred to, for brevity, as "substrate") must be ground before it is subjected to a polishing process followed by coating with a magnetic material.

A conventional grinding apparatus includes, as shown in FIG. 4, upper and lower platens 10 and 12 which are formed of rigid circular plates of stainless steel, for example, for securing thereto heavy grinding wheels 14, 16. The grinding wheels 14, 16 are annular in shape and have a central opening defined therein. The upper platen 10 is rotatably supported by a ball bearing arrangement (not shown). The conventional grinding apparatus also includes, as shown in FIGS. 4 and 5, a sun gear 18, a plurality of substrate carriers 20 (five being shown) for holding at least one substrate thereon, and an internal ring gear 22 forming a part of the lower platen 12 and having teeth on the inner surface of its rim. The substrate carriers 20 are capable of being induced to revolve around the sun gear 18 while simultaneously rotating about their own axes. These structural members 18, 20, 22 will be described below in greater detail. Two driving shafts 11 and 19 are connected to the upper and lower platens 10 and 12, respectively.

In the conventional grinding apparatus shown in FIGS. 4 and 5, there are five substrate carriers 20 and each of the five substrate carriers 20 has two substrate holding portions 24 in the form of circular recesses. When the sun gear 18 is driven to rotate, the substrate carriers 20 which are disposed between the sun gear 18 and the internal gear 22, revolve around sun gear 18 while rotating about their own axes. With this construction, when each of the substrate holding portions 24 contains a substrate, and the upper platen 10 (FIG. 4) is then lowered so as to grip the substrates between the upper grinding wheel 14 and the lower grinding wheel 16, suitable rotation of the sun gear 18 will ensure that plural substrates (ten substrates in the case shown in FIGS. 4 and 5) are ground at one time.

As time passes the grinding operations will cause blinding or jamming of spaces defined between abrasive grains of the grinding wheels and also wear abrasive grains down. This of course leads to a reduction in the grinding characteristics (cutting quality).

The grinding wheels 14, 16, therefore, require periodical dressing to restore their original sharpness or cutting quality. To this end, in the case of the conventional grinding apparatus such as shown in FIGS. 4 and 5, the thickness of the ground substrates is measured manually, and if the amount of grind (i.e., the amount of material removed by grinding) for a given period of time is less than a predetermined value, the grinding wheels are dressed in the following manner.

At least one of the substrate carriers 20 is removed and, thereafter, a circular dressing disk, which has the same diameter as the substrate carrier 20, and which has diamond particles or grains on both faces, is disposed in the grinding apparatus in place of the removed substrate carrier 20. The sun gear 18 is then rotated to cause the circular dressing disk to revolve about the sun gear 18 while rotating about its own axis. As a result, the grinding wheels 14, 16 are dressed by the circular dressing disk.

According to the conventional grinding apparatus described above, the substrate carrier 20 must be replaced with the circular dressing disk each time the grinding wheels are to be dressed. Such replacement work shuts down the operation of the grinding apparatus for a undesirably long period and, hence, considerably lowers the productive efficiency of the grinding apparatus.

In addition to the above drawback, the conventional grinding apparatus is not fully automatic. Furthermore, it is difficult to obtain the required precision over the entire surface of the grinding wheel when it is dressed with the diamond grain dressing disc, as diamond grains tend to wear unevenly.

SUMMARY OF THE INVENTION

With the above mentioned drawbacks of the prior art in view, it is an object of the present invention to provide an apparatus for grinding hard disk substrates, which requires only a very short downtime for dressing purposes.

Another object of this invention is to provide a hard disk substrate grinding apparatus which is capable of dressing grinding wheels precisely in a short period of time.

A further object of this invention is to provide a grinding apparatus suited for automated operation.

In brief, the above objects are achieved by an arrangement wherein an apparatus for grinding hard disk substrates includes a dressing unit which is radially movable across the faces of the grinding wheels while they are being driven to rotate and thus enable simultaneously dressing one or both of the two confronting surfaces thereof. The apparatus thus constructed is suited to fully automated grinding/dressing operations.

More specifically, a first aspect of the invention comes in an apparatus for grinding hard disk substrates, which features: an upper platen and a lower platen which are rotatable about a vertical axis and movable relative to one another; a first grinding wheel secured to a lower side of said upper platen; a second grinding wheel secured to an upper side of said lower platen; a plurality of substrate carriers detachably mounted on said lower platen for holding at least one hard disk substrate on each of said substrate carriers, said substrate carriers being geared to revolve about said vertical axis while rotating about their own axes; and dressing means linearly movable in a direction which is essentially radial with respect to the vertical axis for dressing a grinding face of one of one of said first and second grinding wheels.

A further aspect of the present invention provides apparatus in which dressing means comprises: a dressing unit having a diamond tip engageable with a grinding surface; a motor operatively connected with said dressing unit for reciprocating said dressing unit; and adjusting means for finely adjusting an angle of inclination of said dressing unit relative to the grinding surface.

Another aspect of the invention includes means for measuring the thickness of each substrate before and after the substrate is ground by said first and second grinding wheels; means for detecting an amount of grind for a predetermined period of time when said amount of grind is less than a predetermined value; and means for activating said dressing means in response to an output from said detecting means.

Yet another aspect of the invention comes is one in which the detecting means comprises: storage means operatively connected with said measuring means for storing the results of measurement supplied from said measuring means before the substrates are ground by said first and second grinding wheels; and an arithmetic processing means operatively connected with said measuring means and said storage means for determining said amount of grind in terms of the difference between the results of measurement stored in said storage means and the results of measurement supplied from said measuring means after the substrates are ground by said first and second grinding wheels, then comparing said amount of grind with said predetermined value, and generating said command signal when said amount of grind is less than said predetermined value.

BRIEF DESCRIPTION OF THE DRAWINGS

The above and other objects, features and advantages of the present invention will become more apparent from the following description taken with the appended drawings wherein.

DETAILED DESCRIPTION OF THE INVENTION

Figure 4:
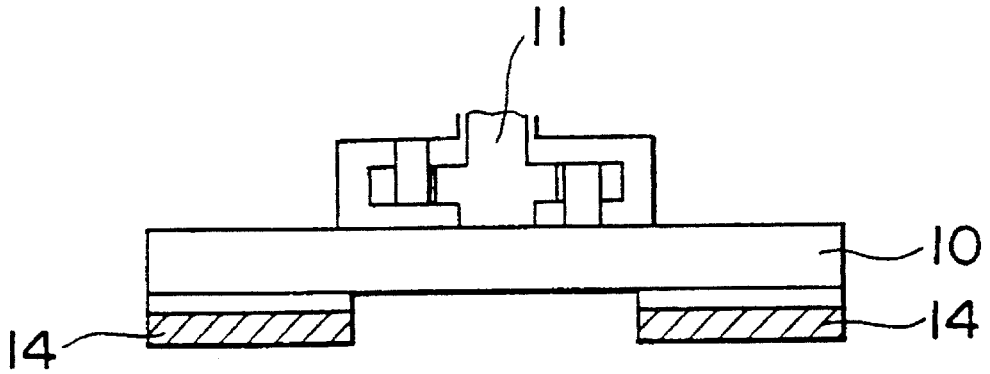
FIG. 4 PRIOR ART
FIG. 4 is a diagrammatical side elevational view of a conventional hard disk substrate grinding apparatus.
Figure 4:
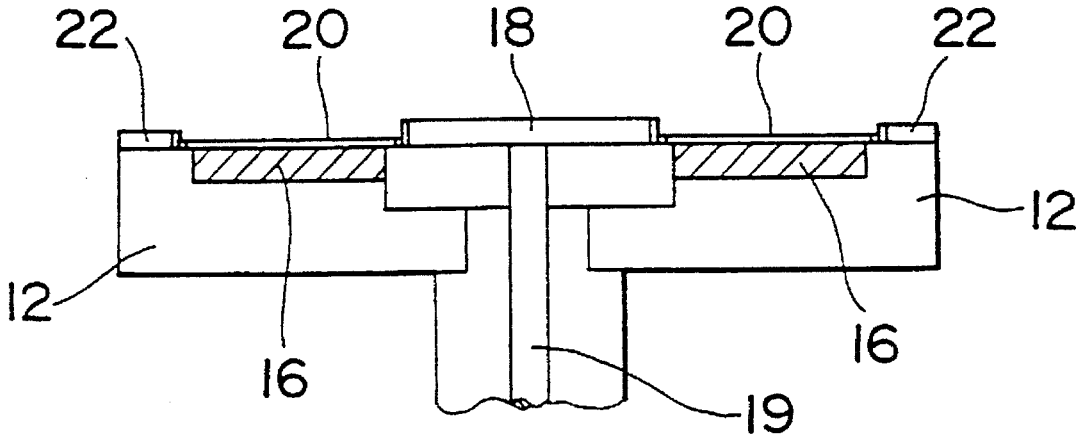
FIG. 4 PRIOR ART
Figure 5:
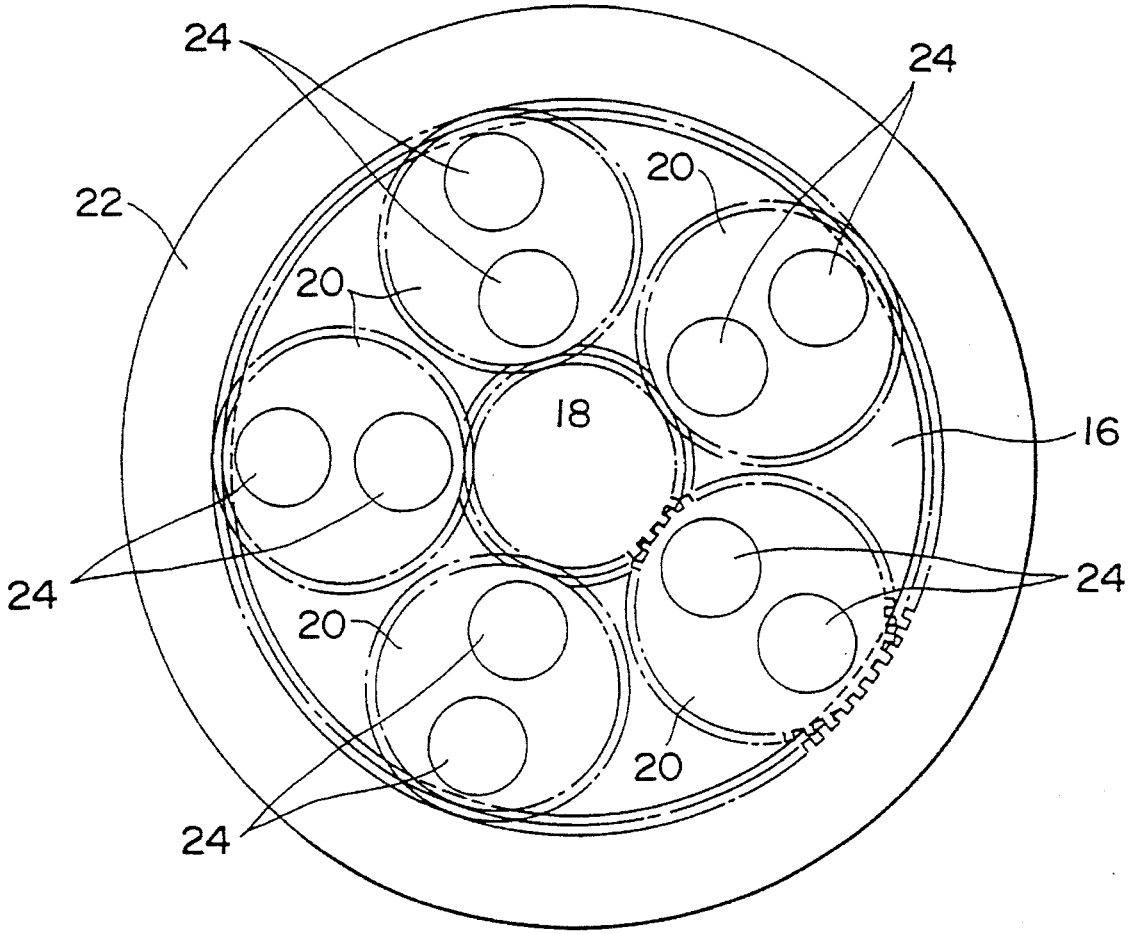
FIG. 5 PRIOR ART
FIG. 5 is an enlarged plan view of a lower portion of the conventional hard disk substrate grinding apparatus.

The invention will be described below in greater detail with reference to a preferred embodiment illustrated in FIGS. 1 and 2. The parts which correspond to those shown in FIGS. 4 and 5 are designated by the same or corresponding reference characters.

Figure 1:
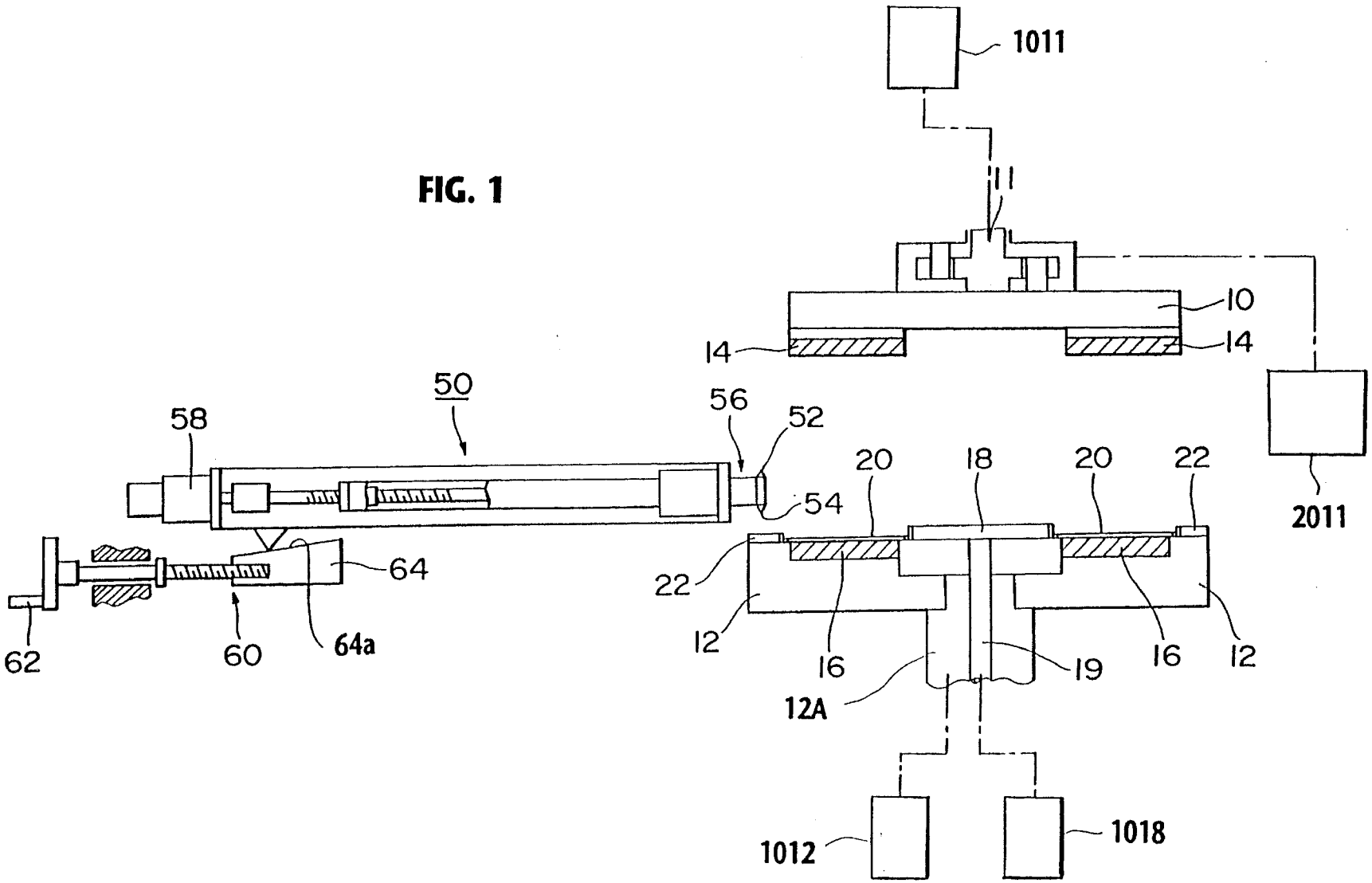
FIG. 1 is a diagrammatical side elevational view of an apparatus for grinding hard disk substrates according to the present invention.
Figure 2:
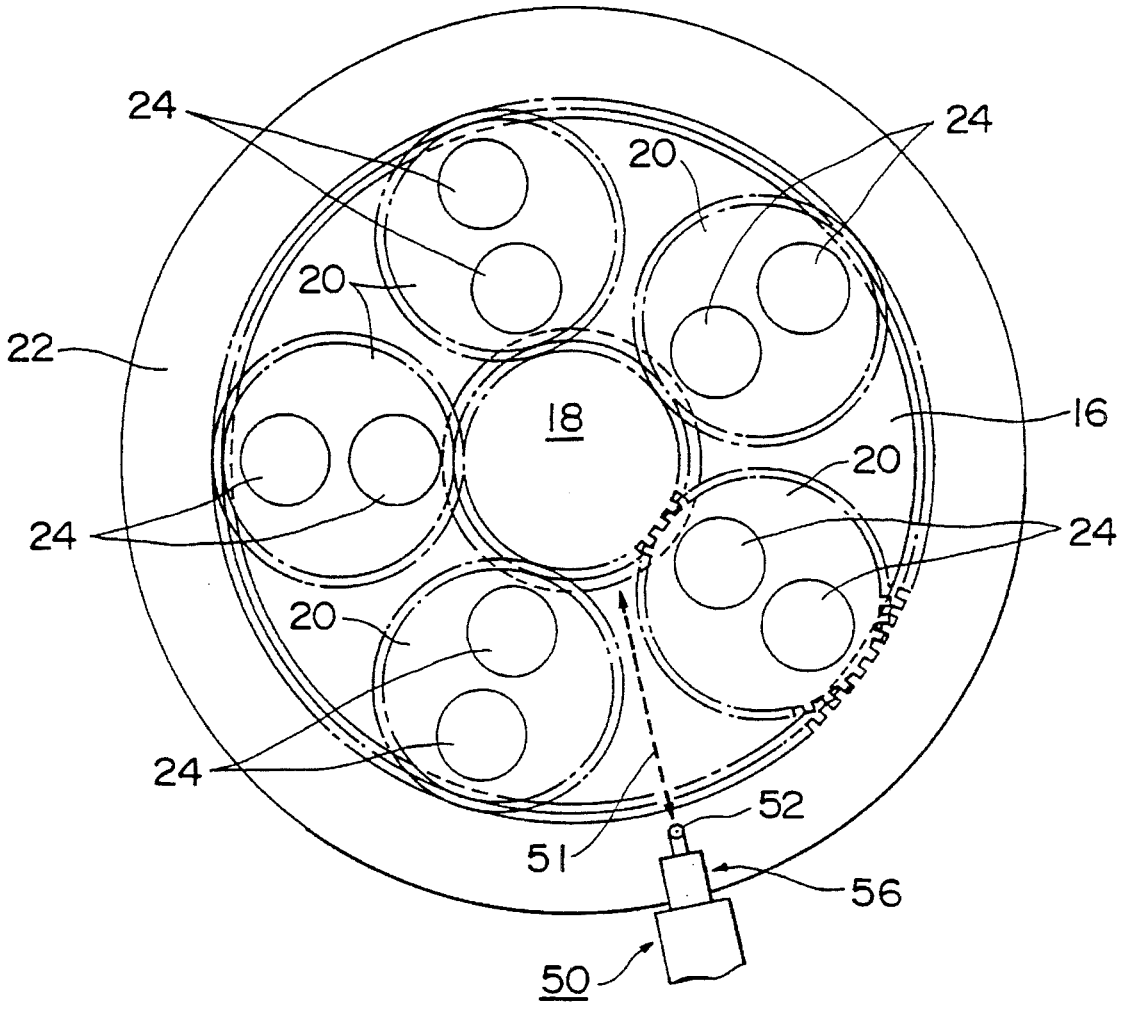
FIG. 2 is an enlarged plan view of a lower part of the apparatus shown in FIG. 1.

FIG. 1 shows the general construction of a hard disk substrate grinding apparatus according to the present invention. The grinding apparatus includes upper and lower platens 10, 12 which comprise rigid circular stainless steel discs and which are arranged to support heavy grinding wheels 14, 16. The grinding wheels 14, 16 have an annular configuration. The upper platen 10 is rotatably supported by a ball bearing (not shown). A driving shaft 11 is secured at its one end to the center of the upper platen 10.

The grinding apparatus also includes a sun gear 18, a plurality of substrate carriers 20 (five being shown in FIG. 2) for supporting thereon at least one substrate and an internal ring gear 22 which forms a part of the lower platen 12. Each of the substrate carriers 20 has gear teeth on its outer peripheral edge so that the substrate carriers 20 are able to revolve around the sun gear 18 while rotating their own axes. A drive shaft 19 is connected at its upper end to the center of the lower platen 12.

In this arrangement the upper and lower platens 10, 12 and the sun gear 18 are each operatively connected with motor arrangements which allows the rotation of the three elements to be individually controlled. That is to say, as shown, shaft 11 is operatively connected with motor 1011, a shaft 12A which is rigid with the lower platen is operatively connected with motor 1012 while the sun gear drive shaft 18 is operatively connected with a motor 1018.

A motor driven arrangement generally denoted by the numeral 2011 is provided for raising and lowering at the least the upper platen 10 and for controlling the position thereof with respect to the lower platen 12.

Each of the five substrate carriers 20 has two substrate holding portions 24 in the form of circular recesses. When the sun gear 18 rotates, the substrate carriers 20 which are disposed between the sun gear 18 and the internal gear 22 revolve around sun gear 18 while rotating about their own axes. With the grinding apparatus of the foregoing construction, two substrates are loaded into the substrate holding portions 24. After this, the upper platen 10 (FIG. 3) is lowered to a grinding position wherein the substrates are gripped between the upper and lower grinding wheels 14, 16.

While maintaining this condition, the sun gear 18 and the upper and lower platens 10, 12 are driven to rotate in a suitable manner with the result that all the substrates are ground at the same time by the grinding wheels 14, 16.

As shown in FIG. 1, the grinding apparatus further includes a dressing arrangement generally denoted by the numeral 50. This arrangement includes a dressing unit 56 having upper and lower diamond tips 52, 54, a motor 58 for moving the dressing unit 56 back and forth, i.e., generally toward and then away from about the center of the upper and lower platens 10 and 12 and a dressing unit inclination adjusting device 60 for finely adjusting the angle of inclination of the dressing unit 56 relative to grinding surfaces of the upper and lower grinding wheel 14, 16.

The dressing unit 56 is arranged to be linearly movable across the surfaces of the grinding wheels 14, 16 in a manner which enables the confronting grinding surfaces of the upper and lower grinding wheels 14, 16 to be dressed by the upper and lower diamond tips 52, 54. The dressing unit inclination adjusting means 60 includes a handle 62 which enables a wedge-like tilting block 64 to be manually adjusted in a manner to finely adjust the angle of inclination of the dressing unit 56 relative to a horizontal plane.

Figure 3:
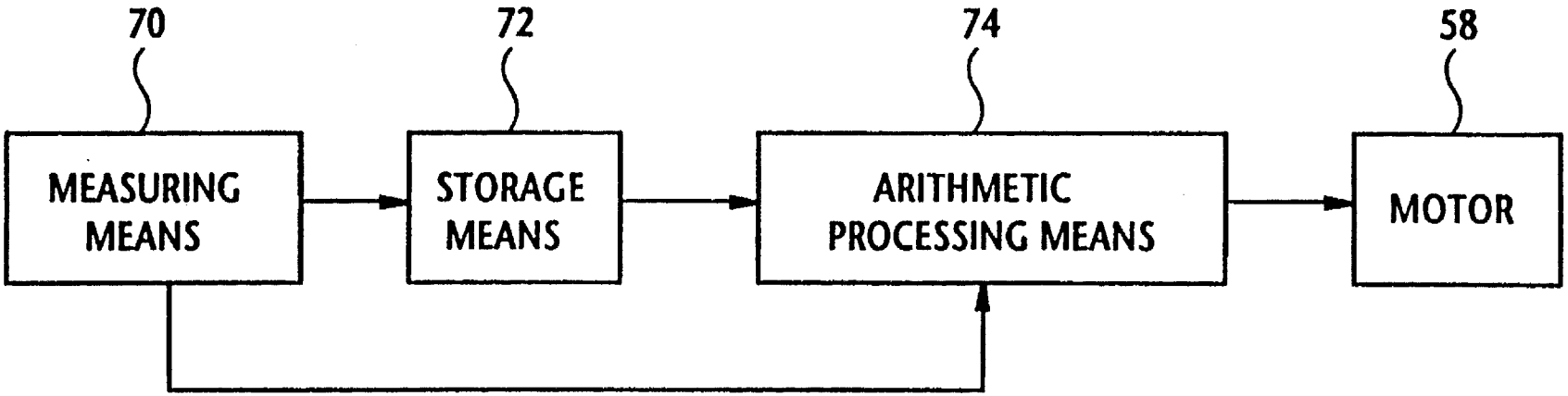
FIG. 3 is a block diagram showing an arrangement provided for automatically performing the dressing operation of the apparatus.

To perform a dressing operation, the thickness of each substrate is measured at one or more portions by a measuring means 70 (FIG. 3), and the results of measurement (measured values) are stored in a storage means (memory) 72 (FIG. 3). The measuring means 70 comprises a known non-contact laser beam type measuring instrument, for example, and the measurement data generated thereby is stored in a known type of data storage means 72. In the embodiment shown in FIGS. 1 and 2, ten substrates are placed at a time in the substrate holding portions 24 of the substrate carriers 20 mounted on the lower platen 12, after which the upper platen 10 is lowered to grip the substrates between the upper and lower grinding wheels 14, 16. Then, the platens 10, 12 and the sun gear 18 are rotated to cause the five substrate carriers 20 to revolve around the sun gear 18 while rotating about their own axes and for the mutual rotational relationship to be such that the substrates are ground simultaneously by the grinding wheels 14, 16.

The substrates thus ground, are removed and, thereafter the thickness of the ground substrates is measured by the above-mentioned measuring instrument 70. The postgrinding thickness of each substrate (viz., the thickness of the substrates measured after the grinding operation) is compared with the pre-grinding thickness of the same. The pre-grinding thickness of course was measured before the grinding operation and stored in the storage means 72 as noted above. This comparison is performed by an arithmetic processing means 74 (FIG. 4) which is constructed to calculate the difference between the post-grinding thickness and the pre-grinding one. The difference thus calculated indicates the amount of grind (i.e., the amount of material removed by grinding) for a predetermined period of time.

It will be noted that the substrate carriers 20 are controlled to stop at a predetermined position so that the position of the respective substrates held on each substrate carrier 20 can be identified after the grinding operation is completed. Thus, the amount of grinding for a predetermined period of time can be measured accurately.

The arithmetic processing means 74 then compares the amount of grinding for the predetermined period of time with a predetermined value so as to determine whether or not the grinding wheels 14, 16 require dressing.

If the amount of grind for the predetermined period of time is smaller than a predetermined value, the need for the grinding wheels 14, 16 to be dressed, is indicated. Upon this indication, the arithmetic processing means 74 issues a command signal to raise the upper platen 10 until it assumes a predetermined spaced relationship with respect to the lower platen 12. This position is selected to permit the dressing unit to pass between the grinding surfaces with the diamond tips 52, 54 engaging the same in a predetermined manner. At this stage, motors 1011 and 1012 are energized to drive the upper and lower platens 10 and 12, while the sun gear 18 is permitted to idle. Rotation of the motor 58, which controls the linear displacement of the dressing unit 56 radially inward across the faces of the grinding wheels 14, 16 is then induced. As the dressing unit 56 progresses across the faces of the rotating grinding wheels (see FIG. 2), the diamond tips 52, 54 uniformly dress the respective grinding surfaces.

As will be appreciated, by not driving the sun gear 18, the substrate carriers 20 are prevented from being caused to rotate thereabout and from engaging with and interfering with the progress of the dressing unit 56.

Furthermore, the relative position between the upper platen 10 and the dressing means 50 is adjusted such that the confronting surfaces of the upper and lower grinding wheels 14, 16 are dressed precisely by the dressing unit 56. The translation speed of the dressing means 50 is determined with due consideration of the speed of rotation of the grinding wheels 14, 16 with the result that the dressing is performed with an incomparably higher precision accuracy than the conventional practice described above. As shown in FIG. 2, the diamond tips 52, 54 of the dressing unit 56 move along a path extending between two adjacent ones of the substrate carriers 20. This obviates the necessity of removing the substrate carrier or carriers 20 during the dressing operation. In FIG. 2, the path traversed by the diamond tips 52, 54 is indicated by the broken line 51 which is oriented almost radially of the upper and lower platens.

It will be noted that it is within the scope of the present invention to use only one cutting element (diamond tip) and to dress one grinding face at a time. Additionally, the ability to control the angle of cutting unit inclination using the inclination adjusting means 60, the dressing of the grinding faces can be carried out in a manner which facilitates optimal grinding to be achieved. As described above, the grinding apparatus of this invention incorporates therein the non-contact measuring instrument 70 for measuring the thickness of substrates before and after the grinding operation is performed, the storage means 72 for storing the results of measurement on the thickness of the substrates measured by the measuring instrument 70, and the arithmetic processing means for determining the difference between the pre-grinding thickness of the substrates and the post-grinding thickness of the same substrates and comparing the difference with a predetermined value to issue a command signal to activate the dressing means 60 when the difference is less than the predetermined value. The grinding apparatus thus constructed is able to automatically dress the grinding wheels 14, 16. In addition, if the substrates are automatically loaded and unloaded relative to the grinding apparatus, a fully automated operation of the grinding apparatus is possible.

The present invention is not limited to the automatic dressing operation but applicable to the manual dressing operation.

Furthermore, the invention described above is related to the substrate grinding apparatus. This is not restrictive but illustrative. Rather, the invention can be applied to the cleaning of pad surfaces of a substrate polishing apparatus.

Stated more specifically, the grinding apparatus of this invention can be used as a polishing apparatus in which instance the grinding wheels 14, 16 shown in FIG. 1 are replaced with a pair of identical pad support plate wrapped with polishing pads and mounted on the upper and lower platens 10, 12, respectively, and the diamond tips 52, 54 are replaced with scrapers. When the polishing pads requires to be cleaned, the scrapers are moved in a direction perpendicular to the direction of rotation of the polishing pads. With this application of the present invention, the pad cleaning operation can be efficiently as against the conventional manual pad cleaning operation using a cleaning brush.

As will be apparent from the foregoing description, the grinding apparatus of this invention is able to dress the grinding wheels easily during a very short period of time as compared with the conventional grinding machine. Furthermore, the grinding apparatus is suited for automated operation. In addition, this invention also finds application in substrate polishing arrangements and enables a considerable reduction of the pad cleaning time can be achieved.

Obviously, various minor changes and modifications of the present invention are possible in the light of the above teaching. It is therefore to be understood that within the scope of the appended claims the invention may be practiced other than specifically described.

What is claimed is:

1. A method of dressing grinding wheels of an apparatus which includes:

an upper platen and a lower platen which are rotatable about a vertical axis and are axially movable relative to one another;

a first grinding wheel secured to a lower side of said upper platen;

a second grinding wheel secured to an upper side of said lower platen; and a plurality of substrate carriers detachably mounted on said lower platen for holding at least one hard disk substrate on each of said substrate carriers, said substrate carriers being geared to revolve about said vertical axis while rotating about their own axes;

a dressing means having an elongated portion provided with two dressing projections disposed at an end thereof, said method comprising the steps of:

(a) setting a position of said upper platen with respect to said lower platen to a predetermined separation when said first and second grinding wheels are to be dressed;

(b) preventing said substrate carriers from revolving about said vertical axis and from rotating about their own axes while permitting said first and second grinding wheels to rotate; and (c) linearly moving said two dressing projections along a path aligned with an axis of said elongated portion and between adjacent ones of said substrate carriers, movement along said path corresponding to a direction which is essentially radial with respect to said first and second grinding wheels, thereby to dress a grinding surface of each of said first and second grinding wheels using said two dressing projections.

2. A method as claimed in claim 1, wherein the predetermined separation is selected to permit said dressing means to pass between the first and second grinding surfaces with two dressing projections respectively engaging and dressing both grinding surfaces.

3. A method as claimed in claim 1, wherein said elongated portion reciprocates along the axis thereof while dressing the grinding surfaces.

4. A method as claimed in claim 1, further comprising the step of adjusting an angle of inclination of said elongated portion relative to a horizontal plane.

5. A method as claimed in claim 1, further comprising the steps of:

measuring the thickness of each substrate before and after the substrate is ground by said first and second grinding wheels;

detecting an amount of grinding of a substrate for a predetermined period of time;

generating a signal when said amount of grinding becomes less than a predetermined value; and activating said dressing means in response to said signal.

6. The method of claim 1 wherein said two dressing portions are disposed on a dressing portion axis which is generally perpendicular to said elongated portion axis.

* * * * *